US007537045B2

(12) United States Patent
Von Wyl et al.

(10) Patent No.: US 7,537,045 B2
(45) Date of Patent: May 26, 2009

(54) METHOD OF AND INSTALLATION FOR PRECISE POSITIONING OF A NUMBER OF COOPERATING CYLINDER OR ROLLER ELEMENTS

(75) Inventors: Horst Von Wyl, Duisburg (DE); Ulrich Zenz, Duisburg (DE); Frank Moensters, Gladbeck (DE)

(73) Assignee: SMS Demag AG, Duesseldorf (DE)

( * ) Notice: Subject to any disclaimer, the term of this patent is extended or adjusted under 35 U.S.C. 154(b) by 176 days.

(21) Appl. No.: 11/661,457

(22) PCT Filed: Jul. 11, 2006

(86) PCT No.: PCT/EP2006/006741

§ 371 (c)(1),
(2), (4) Date: Feb. 22, 2007

(87) PCT Pub. No.: WO2007/017030

PCT Pub. Date: Feb. 15, 2007

(65) Prior Publication Data

US 2008/0006386 A1 Jan. 10, 2008

(30) Foreign Application Priority Data

Aug. 6, 2005 (DE) ..... 10 2005 037 138

(51) Int. Cl.
*B22D 11/00* (2006.01)
*B22D 46/00* (2006.01)

(52) U.S. Cl. ..... 164/451; 164/151.2; 164/155.4

(58) Field of Classification Search ..... 164/451, 164/155.4, 151.2
See application file for complete search history.

(56) References Cited

U.S. PATENT DOCUMENTS 4,091,542 A 5/1978 Schmid et al.

FOREIGN PATENT DOCUMENTS

JP 5570706 5/1980
JP 58-159954 * 9/1983

OTHER PUBLICATIONS

Search Report.
Joerg-Schilling, et al., Absolute interfacial distance measurement . . . , Physical Review E69, 2004, pp. 021901-1-021901-9.

* cited by examiner

*Primary Examiner*—Kuang Lin
(74) *Attorney, Agent, or Firm*—Abelman, Frayne & Schwab

(57) ABSTRACT

The invention relates to a method of precise positioning of a number of cooperating cylinder or roller elements (2, 3, 4) of a roller or casing installation (1) relative to each other. In order to be able to bring off a rapid and precise alignment of the cylinder or roller elements, according to the invention, it is provided that with a measuring apparatus (5), a distance ($a_6$, $a_7$, $a_8$, $a_9$) between at least three reference points (6, 7, 8, 9), which are provided directly or indirectly on each of the cylinder roller elements (2, 3, 4), and the measuring apparatus is measured, and that dependent on measurement results, adjusting elements (10, 11, 12) on each cylinder or roller element (2, 3, 4) are so operated that the distances ($a_6$, $a_7$, $a_8$, $a_9$) between the reference points (6, 7, 8, 9) and the measuring apparatus conform to predetermined values to a best possible extent, wherein the measurement points (6, 7, 8, 9) of each cylinder or roller element (2, 3, 4) are arranged, directly or indirectly on a carrier element (13) of the cylinder or roller element (2, 3, 4). The invention further relates to a roller or casting installation, in particular for carrying out the method.

18 Claims, 3 Drawing Sheets

METHOD OF AND INSTALLATION FOR PRECISE POSITIONING OF A NUMBER OF COOPERATING CYLINDER OR ROLLER ELEMENTS

BACKGROUND OF THE INVENTION

1. Field of the Invention

The invention relates to a method of precise positioning of a number of cooperating cylinder or roller elements of a roller or casting installation relative to each other. The invention further relates to a roller or casting installation with a plurality of cooperating cylinder or roller elements.

2. Description of the Prior Art

In continuous casting installation in particular, it is necessary to align as precisely as possible a number of cooperating roller elements relative to each other, with the roller elements forming, in an aligned condition, a casting bow for the cast metal strand.

In order to carry out the alignment, it is known to determine positions of separate roller element of a casting installation by measurement using theodolites, leveling instruments, profile batter boards. At that, primarily, a reference is made to reference marks associated with separate elements which do not remain stationary relative to the ideal measurement references line of the installation, i.e., as a rule, to the passing line of the rear edge of the strand (thermal expansion, foundation settlement). Each separate measurement provides, respectively, only two of three spacial coordinates of a measurement point. A complete determination of the measurement point in space is effected by cross-correlation that is carried out primarily manually with a tachymeter.

For control after an optical measurement, often, transitions between segments are measured again. At that, often, discrepancies appear between the expected results from the roller plan, i.e., between theoretical set positions, the produced measurement results, and the results of control measurement.

In order to achieve an optimal balance of separate positions of a cylinder or roller element (ideal position-measurement control), very high expenses become necessary. Typically, alignment of all of the roller elements of a continuous casting installation lasts about two weeks. Besides, erroneous alignment cannot always completely be avoided, which causes, as a result, quality problems and production constraints. Correspondingly high are follow-up costs of an unsatisfactory alignment of separate elements of a continuous casting installation.

In order to eliminate the discernable erroneous positions of the roller elements, in particular, the discernable errors caused by a so-called re-alignment, separate roller elements (segments) should be taken away with a crane or a manipulator and put at another location. Then, the positioning shim packages should be dismounted, exchanged, and be again mounted and secured.

Thereafter, the segment can be mounted back. Because often only one crane or manipulator is available, all of the segments should be aligned one after another. The time period per segment amounts to at least form two to three hours, wherein the alignment of up to fifteen segments per strand is necessary, in particular with a new construction or after a modification.

In FR 26 44 715, for alignment of a number of rollers of a casting installation, a laser beam is used, wherein the distance of separate elements of the installation to the laser beam is determined. The laser beam also serves as a quasi solder. A similar solution is disclosed in U.S. Pat. No. 4,298,281.

DE 101 60 636 A1 discloses a method of adjusting a casting gap in a strand guide of a continuous casting installation. In order to provide for a simple measurement, determination of defects, and malfunction-free start of casting, it is contemplated to adjust the casting gap before start of casting in accordance with an ideal course of the strand thickness with a positioning system. After the start of casting, the continuous and discontinuous point-free casting gap is adjusted under an operational load. Special measures for aligning of separate segments of the installation are not disclosed at this solution.

The measurement of distances of separate rollers along a casting bow for checking the alignment of rollers is disclosed in JP 55 070 706A.

U.S. Pat. No. 3,831,661 discloses that for alignment of separate segments of a continuous casting installation, the separate segments are provided with reference marks to which a gauge can be attached to be able to check the relative position of adjacent segments.

Other solution related to alignment of two machine parts, in particular, rollers relative to each other are disclosed in EP0 075 550 B1, EP 222 732 B1, EP0 867 649 B1, FR 2 447 764A, CH 583 598, DE-AS-27 20 116.

It should be pointed out that the drawbacks of conventional methods and associated therewith installations for aligning separate cylinder or roller elements of a roller or casting installation consists in that the necessary alignment time is very long, in particular, after modification or servicing of the installation. The availability of the installations is thereby low, which results in high operational costs. Further, the precision with which the alignment of separate elements can be carried out, is at least partially not satisfactory, which results in that the product quality is not optimal. Further, a non-optimal alignment of the elements relative to each other reduces reliability of the process and increases its susceptibility to errors.

Different solutions of state of the art bring only partially better results. Anyway, these are not satisfactory for a high-quality production or for a rapid and efficient alignment of cylinder and roller elements.

SUMMARY OF THE INVENTION

In light of the above-described solutions for alignment of cylinder or roller elements of roller or casting installations, the object of the invention is to so modify a method and an installation of the above described type that the discussed drawbacks are eliminated. The alignment and realignment of segments should be noticeably simpler and as precise as possible. Thereby, a substantial portion of time, which was necessary up to the present, should be saved.

According to the invention, this object is achieved by a method characterized in that with a measuring apparatus, a distance between at least three reference points, which are associated with each of the cylinder or roller elements, and the measuring apparatus is measured, and that dependent on measurement results, adjusting elements of each cylinder or roller element are so operated that the distances between the reference points and the measuring apparatus substantially conform to predetermined values to a best possible extent, wherein the reference points of each cylinder or roller element are provided on a carrier element of the cylinder or roller element.

With provision of at least three reference points per a cylinder or roller element, it is possible to determine the spacial position and alignment of a cylinder or roller element in a simple manner and to so change the determined position by operating adjusting elements that an optimal position of each separate segment is achieved.

Advantageously, it is contemplated to use the method of precise alignment of segments in a continuous casting installation. In this case, the measuring apparatus is arranged substantially in a middle point of a casting bow of the continuous casting installation.

A further development contemplated that more reference points are measured with the measuring apparatus that it's necessary for an unambiguous positioning of the cylinder or roller elements and that an actuation of at least one part of the adjusting elements is carried out according to a regression function based on all of the measurement points. The regression function can be linear or polynomic; naturally, other types of the regression function are possible, e.g., in form of exponential functions. According to this development of the invention, the regression analyses is used as a statistical method for analyses of the measurement data. Thereby, so-called "one-sided" statistical dependencies, i.e., statistical cause-effect-relationships are described by a regression function. Thereby, during positioning of separate cylinder or roller elements, a "true" measurement is provided, see below.

The roller or casting installation with a number of cooperating cylinder or roller elements, is characterized, according to the invention in that each cylinder or roller element has a carrier element on which at least three reference points are arranged, directly or indirectly, wherein the roller or casting installation further includes a measuring apparatus or which can be mounted in the roller or casting installation and which is suitable for undertaking distance and/or angular measurements between itself or a predetermined direction and the reference points.

Advantageously, the cylinder and roller elements form segments of a continuous casting installation. Advantageously, they have at least two cylinders or rollers.

The measuring apparatus is formed, in particular, as a laser tracker or a tachymeter.

Laser tracker provides a highly precise, kinematically three-dimensional measuring system that is in position to carry out a distance measurement with high precision. Tachymeters, the use of which is also contemplated, are, as precision instruments, in a position to precisely measure positions and distances. Electronic tachymeters, which are preferred here, automatically measure the direction in accordance with a target process, e.g., optical using interference methods. The distances are determined by electronic distance measurement. At that, either the propagation time or the phase shift of an emitted and reflected, in a target point, laser beam is measured. The light of the carrier wave of the laser beam lies mostly in the infra-red region or adjacent to the infra-red region of the light spectrum. The reflection of the laser beam in the target point takes place either directly on the surface of the targeted object or in a targeted prism. The measurement value determination with regard to direction and distance is carried out electronically.

The reference points are formed advantageously as balls arranged directly or indirectly on the carrier element.

On each carrier element, adjusting elements can be arranged with which the carrier element can be positioned or displaced relative to its receptacle. The adjusting elements permit advantageously a translational displacement of the carrier element relative to its receptacle. It further can be provided that the adjusting elements would permit rotation of the carrier element relative to its receptacle at least about one special axis, preferably, about the lateral axis.

As adjusting elements, in particular wedge members are used. Thereby, in a simple manner, namely, by tightening or loosening a screw, a translational displacement is produced which dependent on the arrangement of the shoe on the carrier element, would cause a translational and/or rotary movement of the carrier element relative to its receptacle. Preferably, the adjustment should be conducted under a load, i.e., without assistance of cranes or manipulators. Preferably, the adjusting element is formed as a self-locking element.

With the proposed approach and equipment, it is possible to adjust in a simple and rapid manner separate cylinder and roller elements of a roller or casting installation so that they would occupy an optimal position relative to each other.

The invention is advantageously used in continuous casting installations, however, it can also be used in other metallurgical installations such as, e.g., rolling mills and strip handling lines.

With the invention proposal it is possible, among others, to undertake a balance calculation on the basis of the obtained measurement results and to use the results for further measurements. Thereby, the reliability of positioning of separate cylinder or roller elements relative to each other increases, and a "true measurement" can be provided by inclusion of redundant measurement values, thus, e.g., instead of necessary here three reference points, four reference points can be used. It is advantageous to use more reference points, as it is necessary for a mathematically unambiguous (statistically determined) positioning of a body in space. The available redundancy reduces singular errors and serves for providing the above mentioned "true measurement," e.g., by evaluation of the standard deviation.

For a set-actual alignment of separate cylinder and roller elements, an "ideal" roller plan is replaced with a curve that is derived from a balance computation (regression) based on measurement data. By using the redundancy, a measurement error, which cannot be completely prevented, is reduced, and the reliability of the measurement is quantitatively obtained ("true measurement").

A further aspect of the invention consists in that the measurement task for a segment in two steps. Firstly, the measurement of the roller path in the segment and transferring to an external reference point in the workshop is carried out. Secondly, limitation of the installation measurement to measurement of the reference points and the reconstruction of the passing line based on the transfer information is effected. The total expenses would be somewhat bigger because of transfer, however, during work in the workshop, the continuous casting installation can operate further. The upper frame of the segment needs not to be taken off from installation measurements.

There further exists a possibility to get rid of reference to stationary, anchored in the foundation of the installation, reference points by producing a "virtual" reference coordinate system by balance computation based on the measurement itself. This eliminates an expensive transformation of point of origin of the installation coordinates into an operation-ready position on the casting platform.

DETAILED DESCRIPTION OF THE PREFERRED EMBODIMENT

Figure 1:
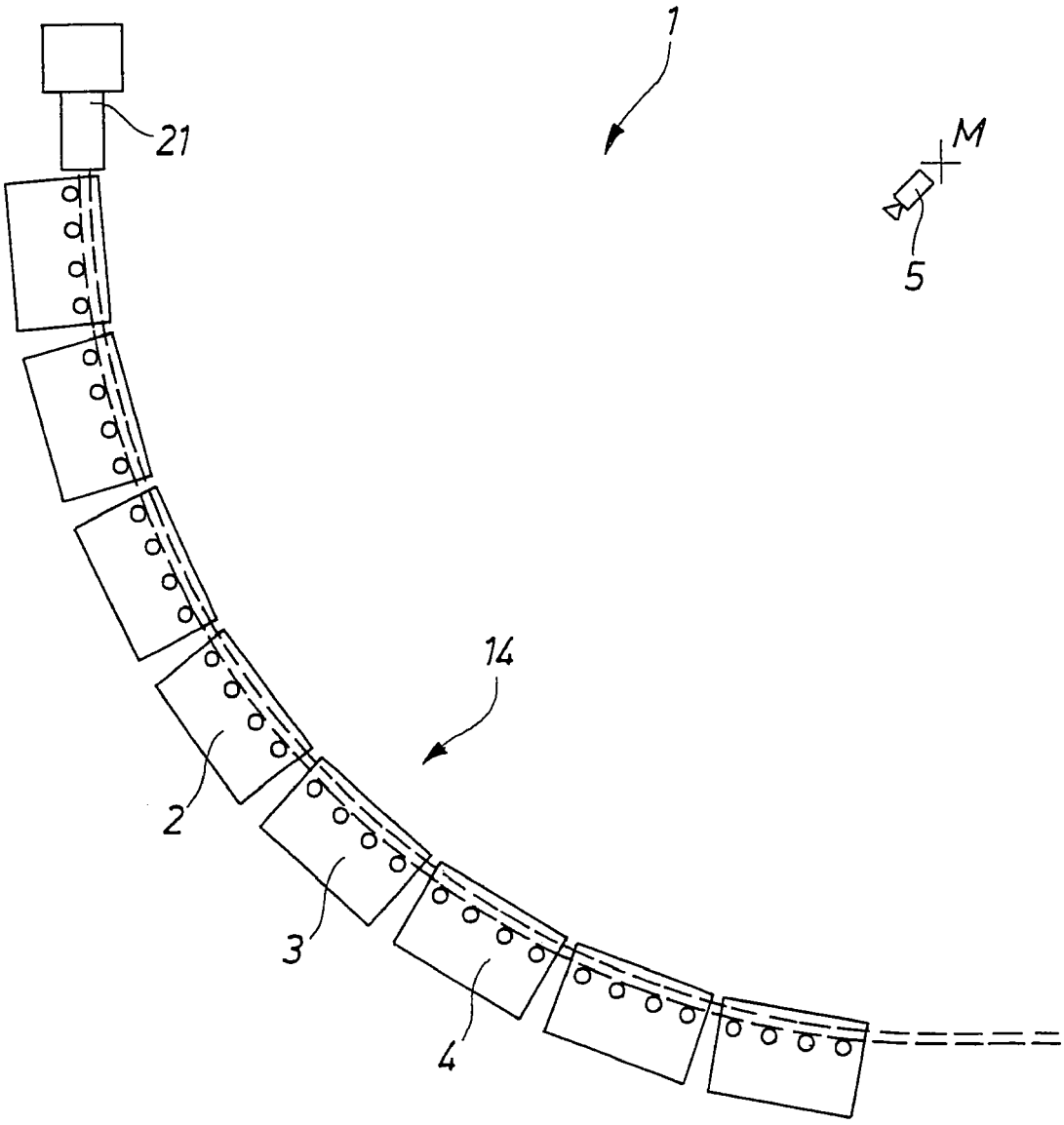
FIG. 1 shows schematically a side view of a continuous casting installation with illustration of some of the components of the installation.

FIG. 1 shows a sketch of a casting installation 1 in form of a continuous casting installation. A liquid metallic material exits a mold 21, flows vertically downwardly, and is gradually diverted from a vertical in a horizontal along a casting bow 14. The casting bow 14 is formed of a plurality of roller elements 2, 3, 4 which are so oriented relative to each other that they form the casting bow 14. It should be noted that actually only lower frames of the segments are shown, which inasmuch is totally appropriate, as the measurement reference line is always the "trailing edge strand." With the concept described below, it is particularly advantageous that the measurement of the installation can also be carried out with a mounted upper frame.

The casting bow 14 has a middle point M, i.e., the cast metal strand runs in quadrantal-shaped manner about the middle point M from the vertical in the horizontal.

In the region of the middle point, but not necessarily exactly in the middle point, a measuring apparatus 5 in form of a laser tracker is arranged.

Figure 2:
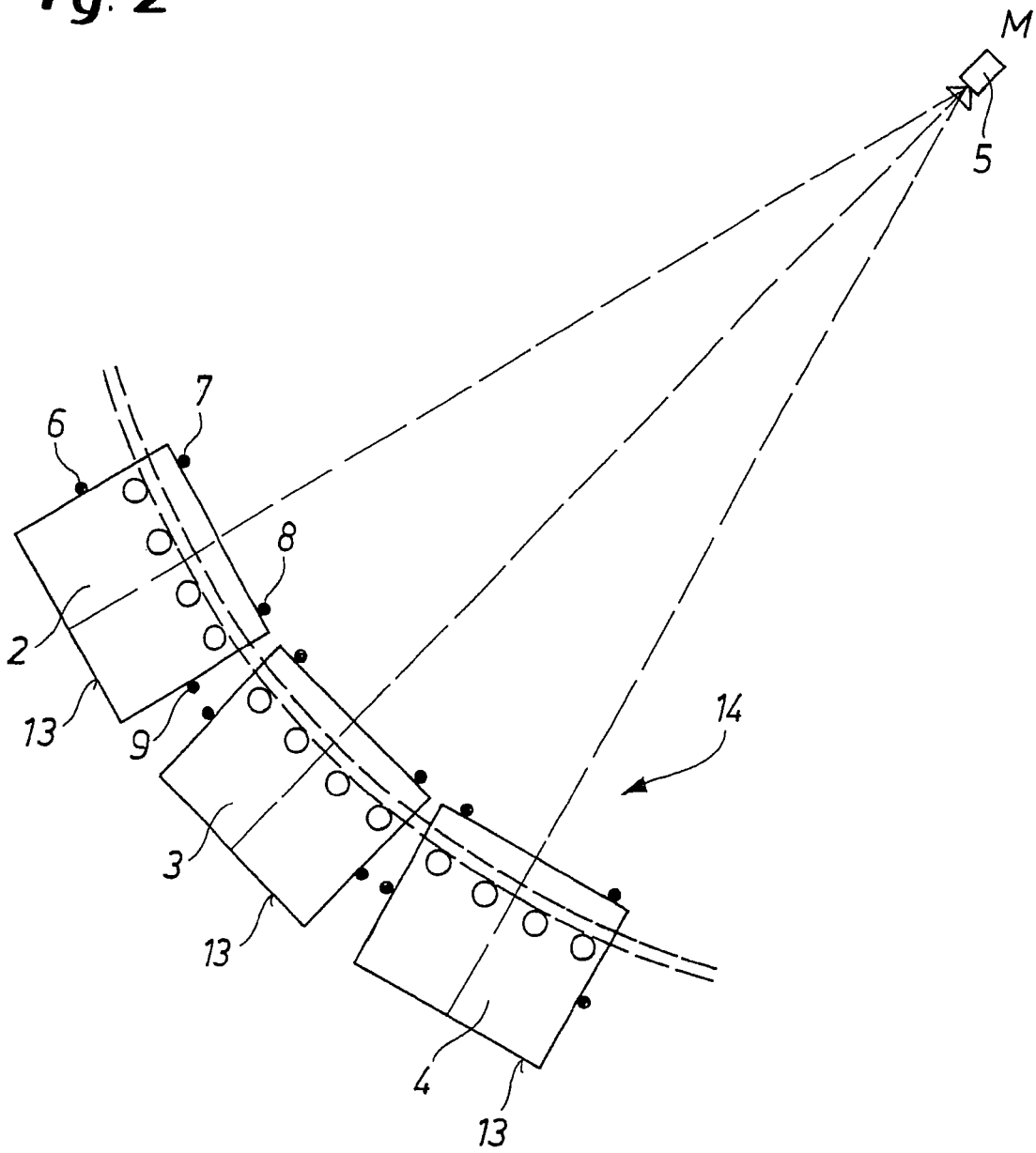
FIG. 2 shows a section of FIG. 1 at an enlarged scale with three roller elements.

As shown in FIG. 2, each roller element 2, 3, 4 has at least three, in the discussed embodiment, four reference points 6, 7, 8 and 9 which are formed as measurement balls provided on a carrier element 13, i.e., on a base frame of a respective roller element 2, 3, 4. For simplicity sake, a measurement ball is being discussed, although, actually and more precisely, a measurement ball holder is meant in which temporarily and only during the actual measurement and alignment process, a measurement ball can be placed. With regard to elements 2, 3, 4 seen in FIG. 2, it should again be noted that it is segment lower frames that are seen.

With regard to the arrangement of the measurement ball in a measurement ball holder, it should be noted that thereby one can purposely react in a simple manner, if necessary, to roller wear or other geometrical changes of the installation or its components.

Figure 3:
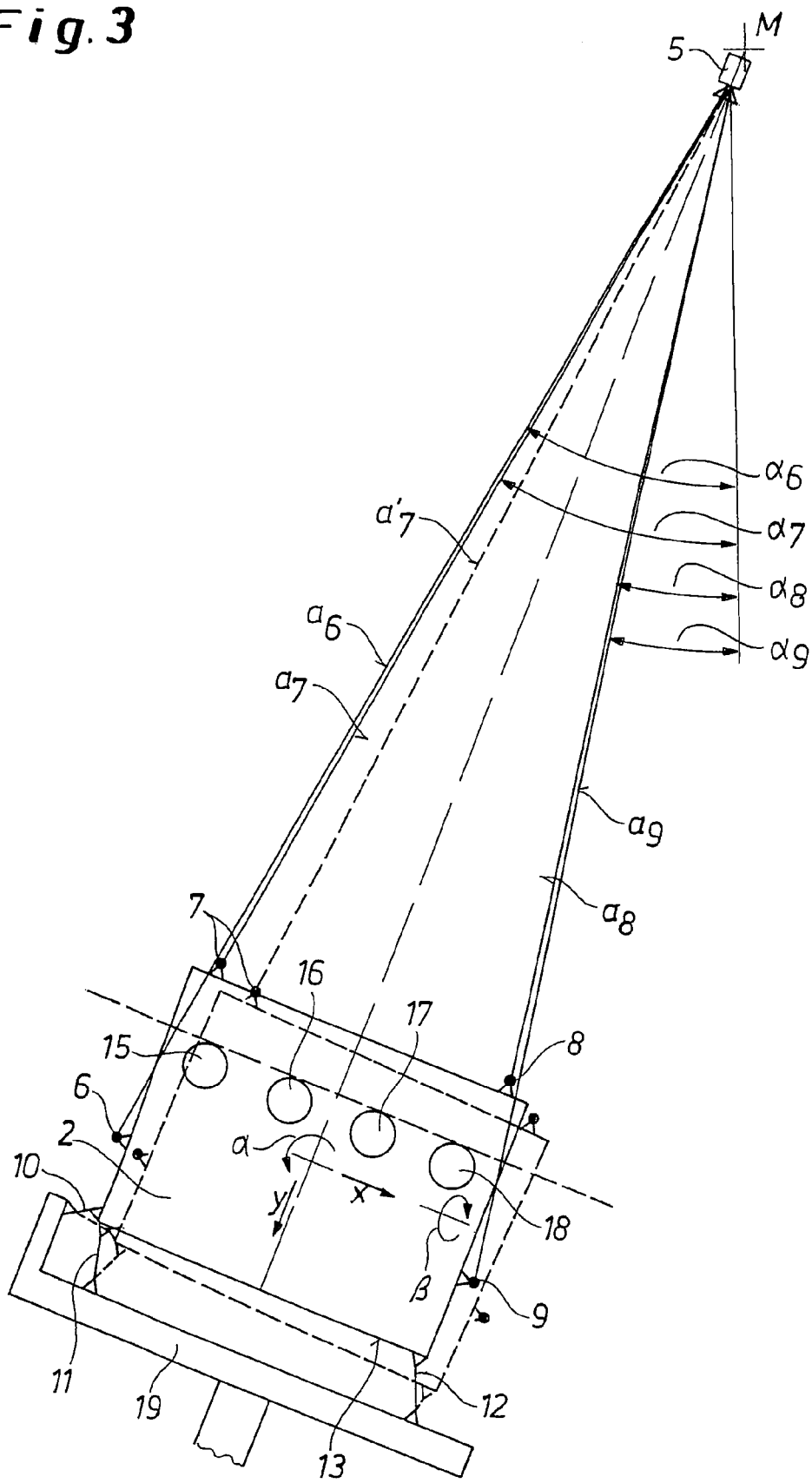
FIG. 3 shows a section of FIG. 2 at an enlarged scale with a single roller element.

As best shown in FIG. 3, a plurality of cylinders or rollers 15, 16, 17, 18 is rotatably supported in each carrier element 13. The carrier element 13 and therewith the entire roller element 2 is secured in a receptacle 19.

The laser tracker 5 has, due to its favorable arrangement in the region of the middle point M, a "visual contact" to separate reference points 6, 7, 8, 9 of each roller element 2, 3, 4. As discussed above, the laser tracker 5 is in a position to measure the precise distances $a_6$, $a_7$, $a_8$, and $a_9$, to reference points 6, 7,8, 9 and, if necessary, the angles $\alpha_6$, $\alpha_7$, $\alpha_8$, and $\alpha_9$, (see FIG. 3). This can be done with a precision of a few tenths of a millimeter.

It should be noted with respect to reference points 7 and 8 that contrary to the view shown in FIG. 2, they are preferably found outwardly on the lower frame of the element 2, 3, 4 and, advantageously, in the same plane as the points 6 and 9, however, on the other side in the casting direction.

The carrier element 13 is arranged in the receptacle 19 with the use of adjusting elements 10, 11, 12 which are shown only very schematically and are formed as machine shoes. The adjustment of the adjusting elements 10, 11, 12 results in that the carrier element 13 and thereby the entire roller element 2 can be displaced both in the translational direction relative to the stationary receptacle 19 and in rotational direction relative thereto. In FIG. 3, from respective three possible translational directions and/or rotational directions in space, only respective two are shown, namely the spacial directions x and y, and the spacial axes $\alpha$ and $\beta$. A corresponding actuation of separate adjustment elements, there can be much more than three that are shown, leads to precise positioning of the carrier element 13 relative to the receptacle 19 in all of the spacial directions and with respect to spacial axes.

It should be noted that FIG. 3 shows merely schematically adjustment possibilities in separate spacial directions and about separate spacial axes, although different axes and direction can have a different greater or lesser importance. Namely, adjustment with the adjustment element 10 is of a subordinate importance as thereby no noticeable influence is exerted on the continuous casting process. The adjusting elements 11 and 12 must have on the opposite side, viewing in the casting direction, a counterpart in order to make the angle $\beta$ adjustable.

FIG. 3 shows schematically the position of the carrier element 13 before the precise alignment with dash lines and the position after the alignment with solid lines. For adjustment of the carrier element 13, the distances $a_6$, $a_7$, $a_8$, and $a_9$, and the associated angles $\alpha_6$, $\alpha_7$, $\alpha_8$, and $\alpha_9$ are measured with the laser tracker 5, i.e., the distances and angles between the measuring apparatus 5 and the reference points 6, 7, 8 and 9 in the form of balls.

The distance between the measuring apparatus 5 and the reference point 7 before the adjustment is indicated, in a manner representative for all other reference points by a reference character $a_7$. The measuring apparatus 5 is connected with computer means (not shown). Based on the floor plan, the set or planned position of the rollers 15, 16, 17 and 18 and, thereby, of the carrier element 13 is stored in the computer means. Because the position of the reference point 6, 7, 8 and 9 on the carrier element 13 is known, immediately, the set positions and set distances between the reference points 6, 7, 8, 9 and the measuring apparatus 5 are obtained. In addition, beforehand, the position of the rollers on the external reference points should transfer and store in the segment repair shop.

The essence of the invention consists in that based on the selection of at least three reference points, the position of the roller element 2 in space is determined. After carrying out he distance measurement between the measuring apparatus 5 and reference points 6, 7, 8 and 9 and based on the given geometry of the roller element 2, it is possible, in a simple way, to calculate the adjustment values for the adjusting elements 10, 11 and 12, which can be carried out automatically in the computer means. With a corresponding actuation of the adjusting elements 10, 11, 12, a very precise and, first of all, a very quick adjustment of the roller element 2 can be carried out in a simple manner.

It should be also noted that in FIG. 3 for the sake of a better clarity an area problem" (two coordinates only) is illustrated. Actually, with at least three reference points, translational and rotational positions of the carrier element 13 and, thereby, of the roller element 2 in space can be determined. By providing the corresponding adjusting elements 10, 11, 12, a roller element can be aligned in space.

The inventive proposal can be again essentially described as follows: The measurement of the strand guide geometry is effected with a measuring apparatus 5, advantageously in form of a laser tracker or a precision tachometer. With its use, "targets" in form of measurement balls are used, so that the position of the carrier element 13 can be determined in three dimensions (each separate measurement provides immediately a spacial coordinate triple. The processing of the measurement data is effected on-line or off-line in a computer.

For determining the positions of separate segments, the position of the roller track is not measured, rather reference points, which are provided on a stationary part of the carrier element (frame), are considered. The position of the reference points relative to the roller tracks decisive for the process is determined initially, e.g., in the workshop by installation (see page 12, lines 8-13). This is possible without any use of spacial alignment stands.

According to the installation measurement, for each reference point, a set value, with reference to the measurement reference system of the installation (roller plan, passing line), is determined.

The results of surveying of the installation can be compared, for evaluation, with its set topology (roller track, passing line), and the deviations from each other can be recalculated in correction values for correction of the position of the segments.

Thereby, it is possible, advantageously, to obtain measurement results by regression to a mean value curve of the measurement data, and to obtain the correction of the deviations from the mean value curve (compensation curve). Thereby, there is produced a new set geometry of the installation that slightly deviates from the original plan. A criterion for finding of this changed set geometry is based on minimization of the shape-changing work of the strand shell. Therefore, the additional expenses can be further reduced without adversely affecting the strand shell ability to withstand the load. In particular, no reference to reference points in the environment of the installation are necessary.

The regression from the (redundant) measurement results can be effected according to a linear polynomial distribution function.

During measurements, a reference point field in the environment of the installation can be used in order to facilitate the change of the site of the measuring apparatus during the measuring process. The resulting, to be-expected error will be reduced because a most possible number of points (the redundancy provides for compensation of errors) is used which are stationary and independent of the to-be-measured object.

For conversion of the evaluated transition errors into height changes of the bearing surfaces of the segment, a program can be used that converts the height correction at the entry and exit rollers (according to the beam set and, if needed, taking into consideration elastic changes of the shape) into bearing points.

For correction of position of the segments, preferably machine shoes wedge members are adjustable under load, are used. Therefore, position corrections of segments can be effected rapidly and without use of cranes or manipulators in accordance with established errors or deviations.

As explained, the measurement should be effected from a side that provides a best possible view of a most possible number of segments of the installation. This is, as a rule, the middle point of the casting bow. When, eventually, the site needs to be changed, an independent reference point system can be used for synchronization of the systems of coordinates with respect to each other.

Advantageously, more reference points 6, 7 8, 9 are provided that is necessary for a clearly definition of the spacial position of a carrier element 13; three point is sufficient in order to define a plane. This overestimation serves, on one hand, for reducing a measurement error that statistically cannot be completely excluded, by a redundant compensation. On the other hand, it is possible to obtain, by evaluation of measurement errors, a measurement that can be trusted.

As is known in the State of the Art, with the inventive concept, segment transition templates can be used in order to check the results of alignment of separate cylinder or roller elements.

Thus, according to the invention, the entire measurement task is divided into a transfer measurement, on one hand, that can take place in the workshop during manufacturing of cylinder or roller elements, and an installation measurement with the reconstruction of the passing line from the transfer measurement, on the other hand, and which takes place before the installation is mounted on the site. This results in an increased reduction of the mounting costs of the roller elements and, thereby, of the operational down-time, which make out the economical advantage of the inventive concept.

List of Reference Numerals

1 Roller or casting installation
2 Cylinder or roller element
3 Cylinder or roller element
4 Cylinder or roller element
5 Measuring apparatus
6 Reference point
7 Reference point
8 Reference point
9 Reference point
10 Adjusting element
11 Adjusting element
12 Adjusting element
13 Adjusting element
14 Casting bow
15 Cylinder/Roller
16 Cylinder/Roller
17 Cylinder/Roller
18 Cylinder/Roller
19 Receptacle
21 Mold
$a_6$ Distance
$a_7$ Distance
$a_8$ Distance
$a_9$ Distance
$\alpha_6$ Angle
$\alpha_7$ Angle
$\alpha_8$ Angle
$\alpha_9$ Angle
M Middle point of the casting bow
x Spacial direction
y Spacial direction
$\alpha$ Spacial axis
$\beta$ Spacial axis

The invention claimed is:

1. A method of precise positioning of a number of cooperating roller elements (2, 3, 4) of a casting installation (1), wherein each of the roller elements (2, 3, 4) has a carrier element (13) and adjusting means (10, 11, 12) for positioning the roller element (2, 3, 4), the method comprising the steps of providing a measuring apparatus (5); measuring distances ($a_6$, $a_7$, $a_8$, $a_9$) between at least three reference points (6, 7, 8, 9) provided on the carrier element (13) of each of the roller elements (2, 3, 4) and the measuring apparatus (5); and dependent on measurement results, operating the adjusting means (10, 11, 12) of respective roller elements (2, 3, 4) to so position the respective roller elements (2, 3, 4) that the distances ($a_6$, $a_7$, $a_8$, $a_9$) between the reference points (6, 7, 8, 9) of the respective roller elements (2, 3, 4) and the measuring apparatus (5) substantially conform to predetermined values.

2. A method according to claim 1, wherein the casting installation (1) is a continuous casting installation, and wherein the step of providing a measuring apparatus (5) includes arranging the measuring apparatus (5) substantially in a middle point (M) of a casting bow (14) of the continuous casting installation.

3. A method according to claim 1, wherein the measuring step comprises measuring, distances ($a_6$, $a_7$, $a_8$, $a_9$) between more than three reference points (6, 7, 8, 9) and the measuring apparatus (5), and wherein the step of operating the adjusting means (10, 11, 12) includes actuation of at least a part of the adjusting means (10, 11, 12) according to a regression function defined by all of measurement points.

4. A method according to claim 1, wherein the regression function is linear.

5. A method according to claim 1, wherein the regression function is quadratic.

6. A method according to claim 1, wherein the measuring step includes measuring angles ($\alpha_6$, $\alpha_7$, $\alpha_8$, $\alpha_9$) between the at least three reference points (6, 7, 8, 9) and the measuring apparatus (5).

7. A casting installation (1), comprising a plurality of cooperating roller elements (2, 3, 4) each having a carrier element (13) provided with at least three reference points (6, 7, 8, 9); and a distance measuring apparatus (5) for measuring distances ($a_6$, $a_7$, $a_8$, $a_9$) between the at least three reference points (6, 7, 8, 9) and measuring apparatus (5).

8. A casting installation (1) according to claim 7, wherein the casting installation is a continuous casting installation, and the roller elements (2, 3, 4) are segments of the continuous casting installation.

9. A casting installation (1) according to claim 7, wherein each of the roller elements (2, 3, 4) comprises at least two rollers (15, 16, 17, 18).

10. A casting installation (1) according to claim 7, wherein the measuring apparatus (5) is formed as a laser tracker.

11. A casting installation (1) according to claim 7, wherein the measuring apparatus (5) is formed as a tachymeter.

12. A casting installation (1) according to claim 7, wherein the reference points (6, 7, 8, 9) are formed as measurement balls arranged on the carrier element (13).

13. A casting installation (1) according to claim 7, wherein adjusting means (10, 11, 12) are provided on each carrier element (13) for positioning the carrier element (13) relative to a receptacle (19) thereof.

14. A casting installation (1) according to claim 13, wherein the adjusting means (10, 11, 12) provides for a translational displacement of the carrier element (13) relative to the receptacle (19) thereof in at least one spacial direction (x, y).

15. A casting installation (1) according to claim 13, wherein the adjusting means (10, 11, 12) provides for a translational displacement of the carrier element (13) relative to the receptacle (19) thereof in a radial spacial direction (x).

16. A casting installation (1) according to claim 13, wherein the adjusting means (10, 11, 12) provides for rotation of the carrier element (13) relative to the receptacle (19) thereof about at least one spacial axis ($\alpha$, $\beta$).

17. A casting installation (1) according to claim 13, wherein the adjusting means (10, 11, 12) provides for rotation of the carrier element (13) relative to the receptacle (19) thereof about a lateral spacial axis ($\beta$).

18. A casting installation (1) according to claim 13, wherein the adjusting means (10, 11, 12) comprises at least one wedge element.

* * * * *